US005946840A

United States Patent [19]

Mickel

[11] Patent Number: 5,946,840

[45] Date of Patent: Sep. 7, 1999

[54] SECURITY LOCK FOR HAND GUN

[76] Inventor: Kenneth L. Mickel, 520 Madison Ave., Suite 520, Toledo, Ohio 43604

[21] Appl. No.: 08/980,808

[22] Filed: Dec. 1, 1997

[51] Int. Cl.[6] ..... F41A 17/06

[52] U.S. Cl. ..... 42/70.11

[58] Field of Search ..... 42/70.11

[56] References Cited

U.S. PATENT DOCUMENTS

| | | | |
|---|---|---|---|
| 3,939,679 | 2/1976 | Barker et al. | 70/277 |
| 4,467,545 | 8/1984 | Shaw, Jr. | 42/70.01 |
| 4,682,435 | 7/1987 | Heltzel | 42/70.01 |
| 5,062,232 | 11/1991 | Eppler | 42/70.11 |
| 5,335,521 | 8/1994 | Brooks | 70/298 |
| 5,467,550 | 11/1995 | Mumbleau | 42/70.11 |
| 5,758,524 | 6/1998 | Yu | 70/276 |

*Primary Examiner*—Charles T. Jordan
*Assistant Examiner*—Denise J. Buckley
*Attorney, Agent, or Firm*—James E. Brunton, Esq.

[57] ABSTRACT

A safety system for disabling a firearm and for maintaining the firearm in the disabled condition. The system is made up of a safety mechanism and personalized code key, which can be conveniently carried by the authorized operator, and which can be inserted into the handle of the weapon to be fired. The safety mechanism includes a specially designed safety lever which is maintained in a disabled, or safe condition, by a uniquely designed pawl element which positively prevents movement of the safety lever into a weapon-firing position until the pawl element is moved relative to the lever by a actuator mechanism of simple design which uniquely comprises a length of electricially conductive wire which shrinks when heated by an electrical current. With this construction, as the actuator wire shrinks, substantial forces are exerted on the pawl element of the system to move it out of the safe or gun-disabling position.

12 Claims, 6 Drawing Sheets

FIG. 5
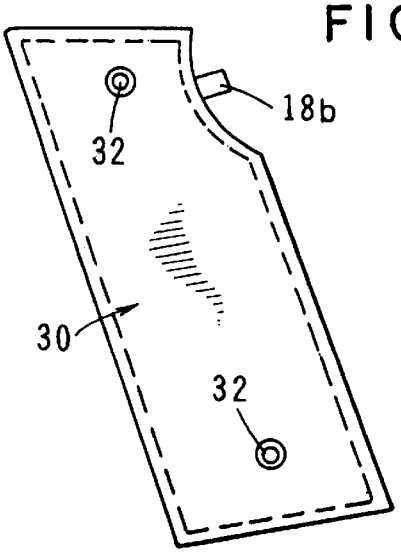
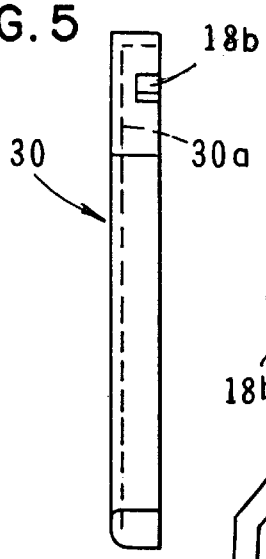
FIG. 6
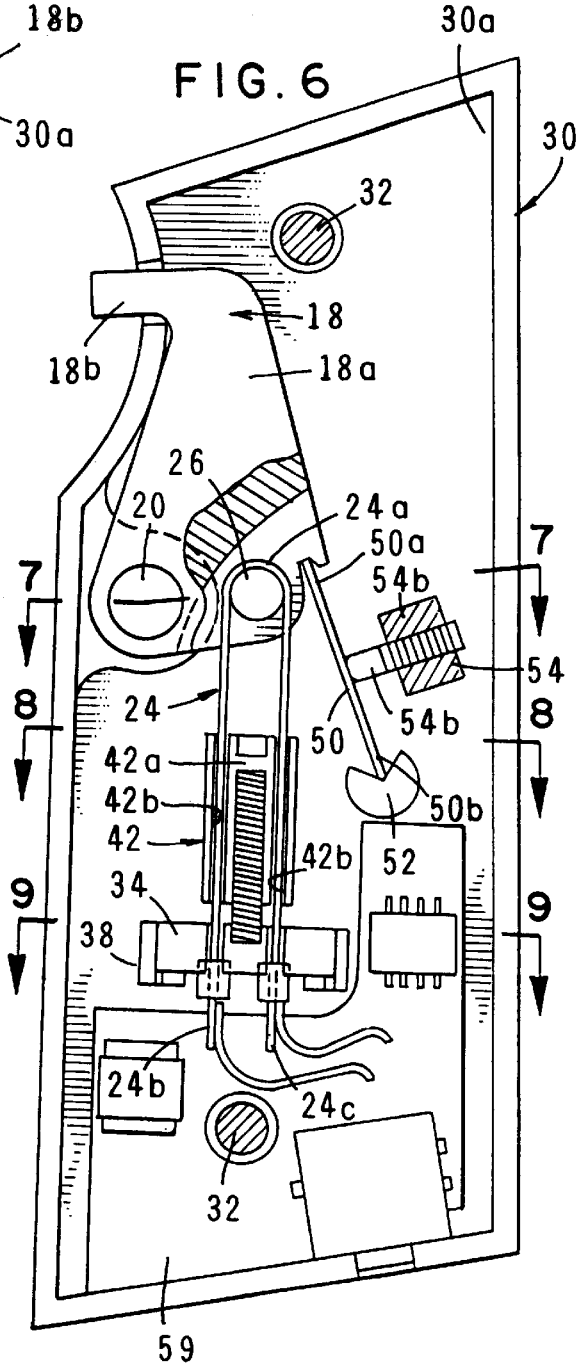
FIG. 4
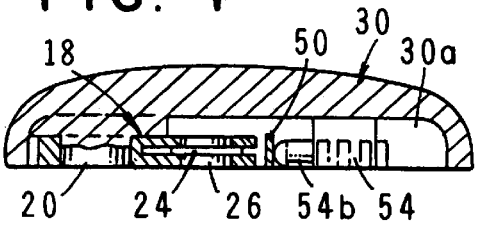
FIG. 7
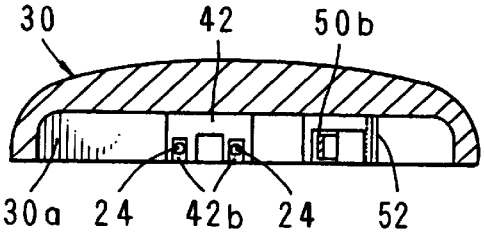
FIG. 8
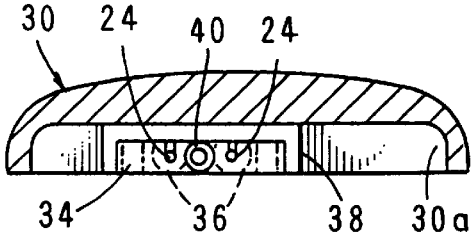
FIG. 9

FIG. 10
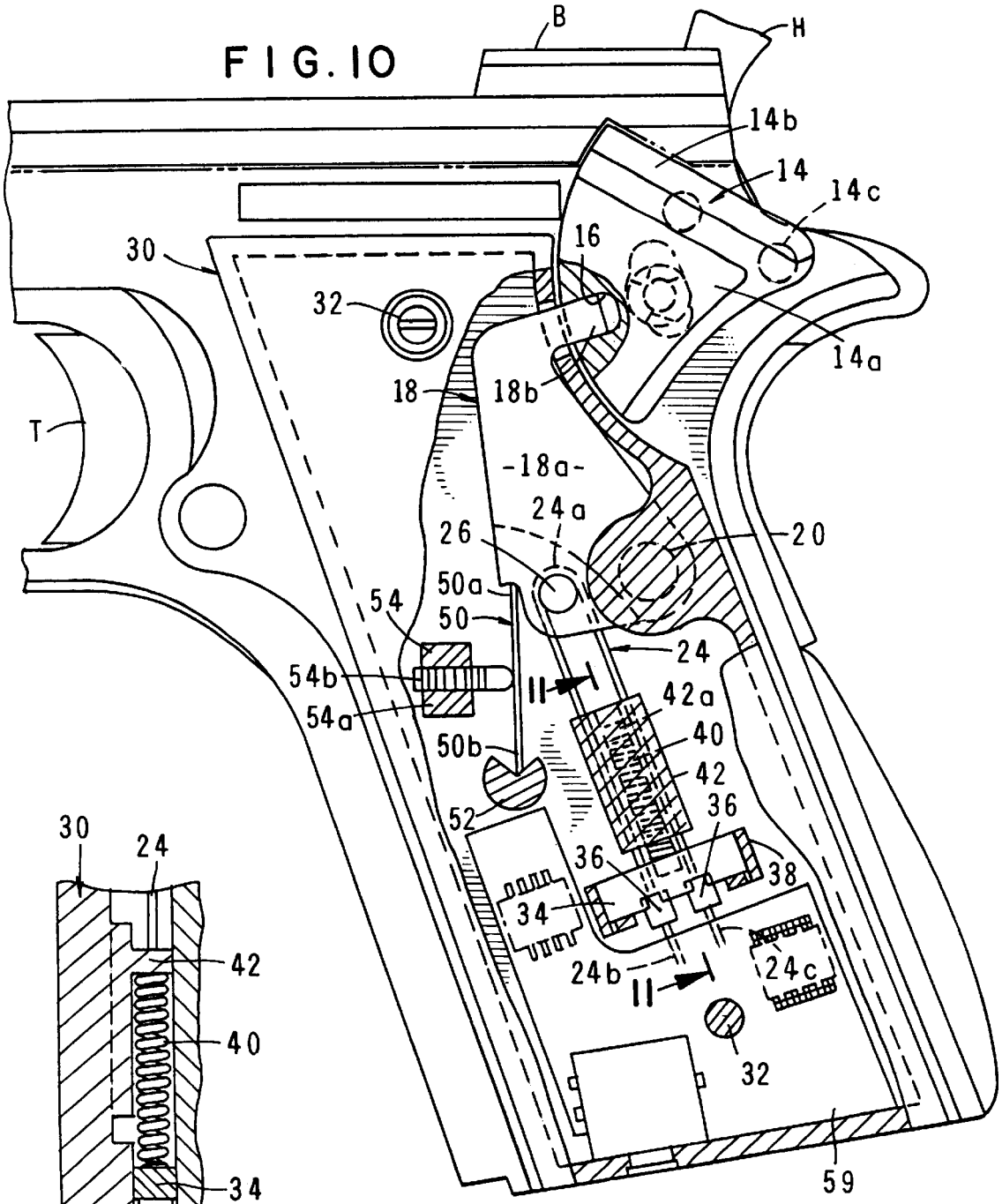
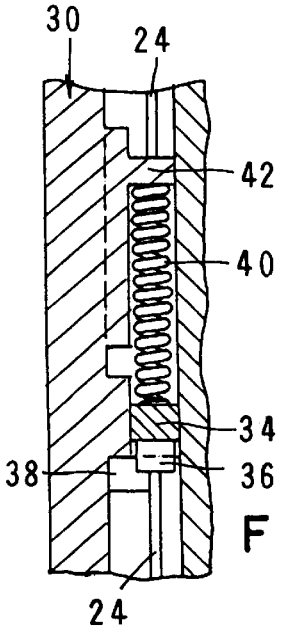
FIG. 11

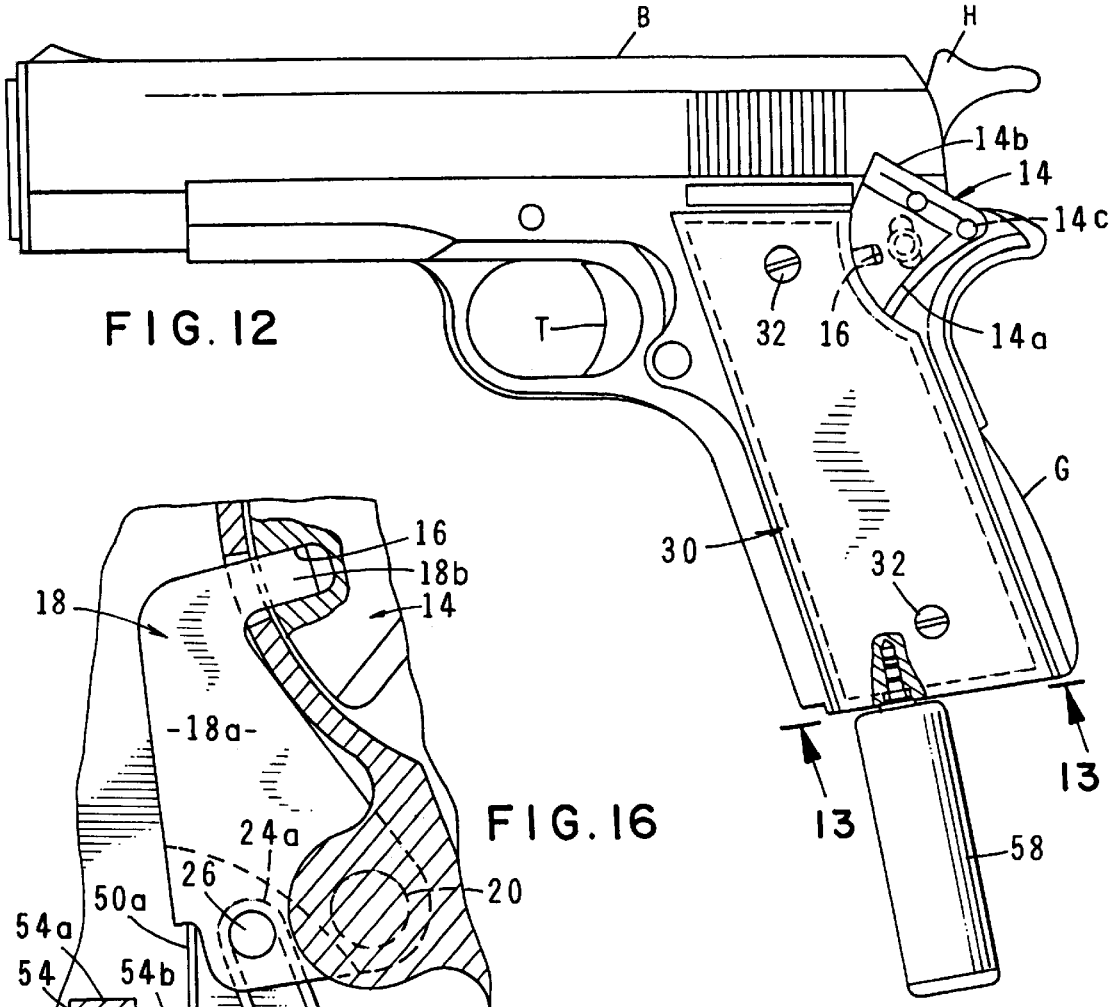
FIG. 12
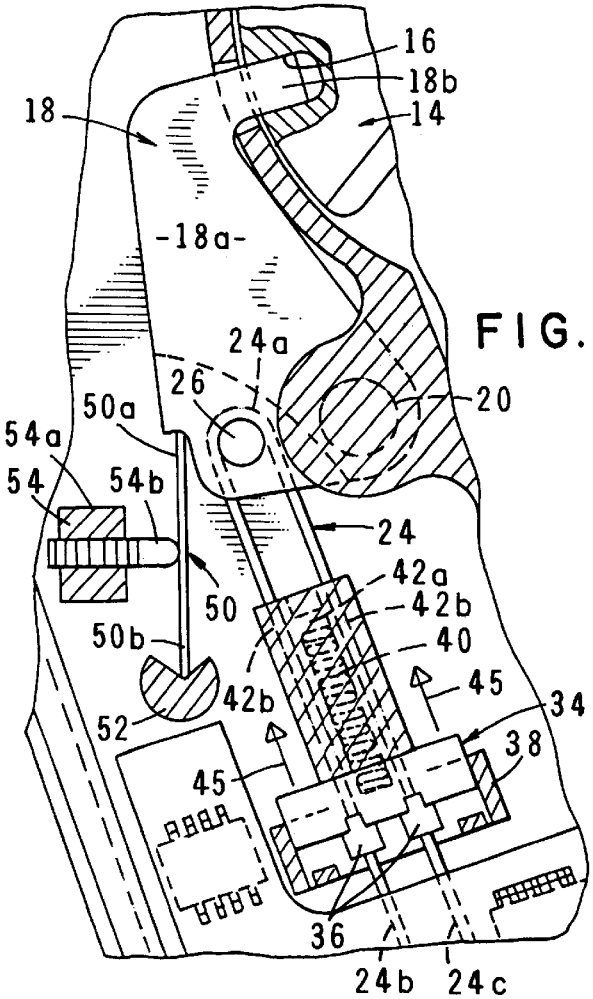
FIG. 16
FIG. 13
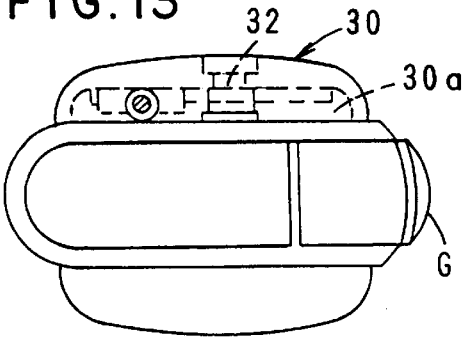

SECURITY LOCK FOR HAND GUN

BACKGROUND OF THE INVENTION

1. Field of the Invention

The present invention relates generally to safety locks for guns. More particularly, the invention concerns a safety device for a hand-held weapon which disables the weapon until a personalized code key is inserted into the handle of the weapon to operate the safety device in a manner to permit the weapon to be fired.

2. Discussion of the Prior Art

There has long been a need for some type of tamper-proof safety device which will prevent the unauthorized firing of weapons such as hand guns. For example, police records are replete with instances of children accidentally firing hand guns which have been carelessly left about by their relatives and parents of their playmates. Such instances often result in the children critically injuring themselves or others. Similarly, private citizens as well as law enforcement officers will, on occasion, have their weapons fall into the hands of an unauthorized person who will use the weapon in the perpetration of serious crimes.

In an effort to prevent unauthorized firing of weapons, many types of safety devices have been suggested. One such prior art device is disclosed in U.S. Pat. No. 4,467,545 issued to Shaw, Jr. This device comprises a hand-held weapon that is fitted with a safety device which is responsive to the palm or finger print of one or more individuals. The safety device is activated by heat sensors when the device is held in the hand of the user. Unless the palm or finger print of the person holding the device matches a pre-stored pattern, a blocking safety mechanism, which normally prevents operation of the weapon, is maintained in its blocking state and the weapon will not fire.

Another prior art safety locking mechanism is disclosed in U.S. Pat. No. 5,016,376 issued to Pugh. The safety mechanism of the Pugh invention includes a solenoid which controllably actuates or deactuates upon an application of an electrical signal. A decoder is mounted within the weapon for detecting a signal from an authorized user and selectively activates the solenoid upon receiving an appropriate signal from the authorized user. A linkage connects the solenoid and the firing mechanism of the weapon for controllably enabling or disenabling the weapon upon operation of the solenoid.

Still another safety system for disenabling a firearm is disclosed in U.S. Pat. No. 4,682,435 issued to Hetzel. The Hetzel safety system includes a mechanical linkage by which the firearm is fired as a result of movement of the trigger. This mechanical linkage includes a specially designed link element. A link mounting means is then provided for mounting this link element within the gun for movement between a position wherein the mechanical linkage is interrupted and a position wherein the mechanical linkage is functional. A link moving means is provided for moving the link element between the interrupted position and the functional position. The safety system further includes a remotely controlled actuating means for actuating the link moving means. This actuating means includes a transmitter for selectively transmitting a gun disabling signal. The transmitter is designed to be carried by the authorized operator of the firearm. A receiver is then located adjacent the link moving means for receiving the signal from the transmitter and for operating the link moving means.

A drawback of many of the prior art safety systems for disabling firearms is that the safety systems tend to be rather complex, difficult and expensive to manufacture and, on occasion, do not exhibit the requisite reliability of operation. These and other drawbacks of the prior art systems are overcome by the novel security system of the present invention which, as will become apparent from the discussions which follows, is of simple design, involves a minimum number of moving parts, and is highly reliable in operation.

SUMMARY OF THE INVENTION

It is an object of the present invention to provide a safety system for disabling a firearm and for maintaining the firearm in the disabled condition. A personalized code key, which can be conveniently carried by the authorized operator, can be inserted into the handle of the weapon to operate the safety system in a manner to permit the weapon to be fired.

Another object of the invention is to provide a safety system of the aforementioned character in which both the safety mechanism and the cooperating, personalized code key of the system are of simple construction and are easy to operate by the hand gun owner.

Another object of the invention is to provide a safety system of the character described in the preceding paragraphs in which the safety lever of the protected weapon is maintained in a disabled, or safe condition, by a uniquely designed pawl element which positively prevents movement of the safety lever into a weapon-firing position until the pawl element is moved relative to the lever by a actuator mechanism of simple design which uniquely comprises a length of electrically conductive wire.

Another object of the invention is to provide a safety system of the class described in which the actuator mechanism of the system comprises a novel actuator wire which shrinks when heated by an electrical current. With this construction, as the actuator wire shrinks, substantial forces are exerted on the pawl element of the system to move it out of the safe or gun-disabling position.

Another object of the invention is to provide a safety system of the character described in the immediately preceding paragraph which requires only very low electrical energy consumption during operation.

Another object of the invention is to provide a novel code key for operating the actuator mechanism of the safety system which contains an embedded semi-conductor chip consisting of a memory and a communication code which stores a unique 64 bit number. The code key also contains a data contact and ground contact to interface with mating contacts provided within the handle portion of the weapon so that the microprocessor can quickly and easily read the code contained within the code key.

Another object of the invention is to provide an apparatus of the character described which is of very simple construction, is easy to operate, can be inexpensively manufactured, and is highly reliable in operation.

The foregoing, as well as other objects of the invention, will be elegantly realized by a novel safety system for a hand gun the construction of which is fully described in the paragraphs which follow.

BRIEF DESCRIPTION OF THE DRAWINGS

FIG. 4 is a front view of the modified hand grip cover of the hand gun within which a portion of the safety system of the invention is housed.

FIG. 5 is a right-side view of the hand grip cover shown in FIG. 4.

FIG. 6 is a greatly enlarged, rear view of the hand grip cover showing in greater detail the construction of a portion of the operating mechanism of the safety apparatus of the invention.

FIG. 7 is a cross-sectional view taken along lines 7—7 of FIG. 6.

FIG. 8 is a cross-sectional view taken along lines 8—8 of FIG. 6.

FIG. 9 is a cross-sectional view taken along lines 9—9 of FIG. 6.

FIG. 10 is a greatly enlarged, fragmentary, side-elevational view of the modified hand gun shown in FIG. 1, partly broken away to show internal construction.

FIG. 11 is an enlarged, cross-sectional view taken along lines 11—11 of FIG. 10.

FIG. 12 is a side-elevational view of the modified hand gun of the invention showing the code key component of the safety system connected thereto.

FIG. 13 is an enlarged view taken along lines 13—13 of FIG. 12.

FIG. 16 is a greatly enlarged, fragmentary view illustrating the modified hand gun in a disabled condition with the safety lever securely locked against movement.

DESCRIPTION OF THE INVENTION

Figure 1:
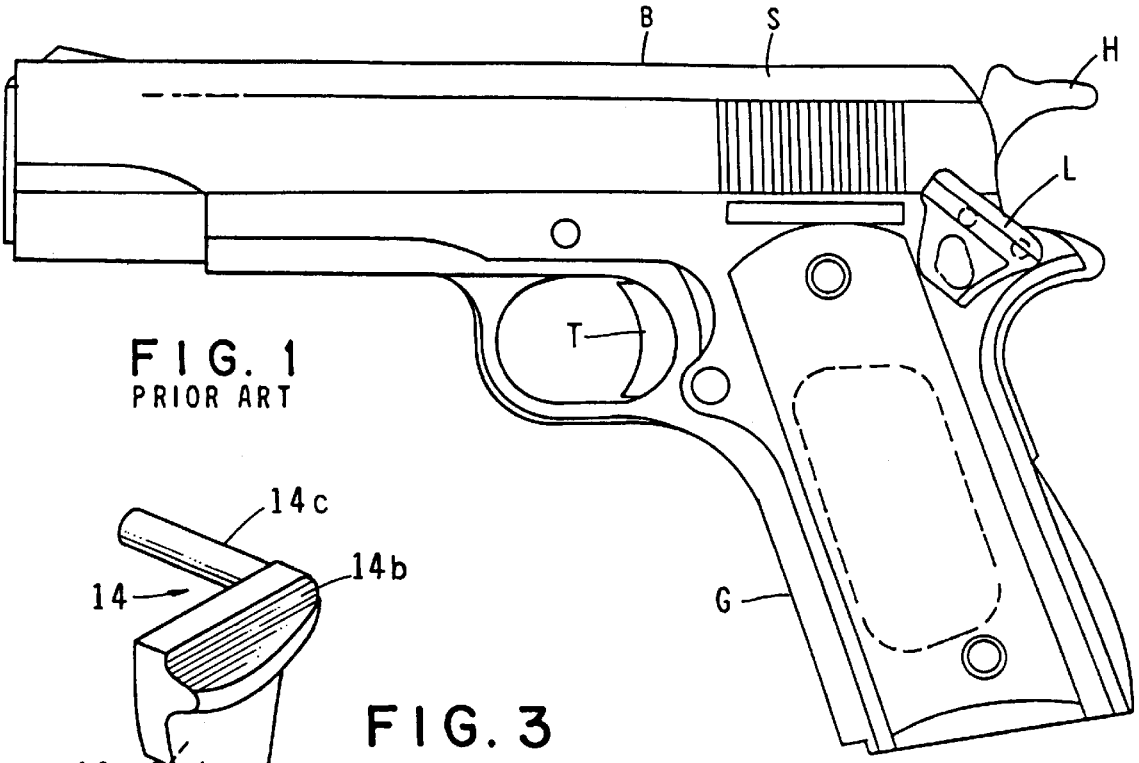
FIG. 1 PRIOR ART
FIG. 1 is a side-elevational view of a conventional prior art hand gun of the character that can be modified to embody the safety system of the present invention.

Referring to the drawings and particularly to FIG. 1, a conventional prior art hand gun of the type that can be modified to incorporate the safety apparatus of the present invention is there illustrated and designated as prior art. The hand gun shown in FIG. 1 is, by way of example, a 45 caliber hand gun of the character manufactured and sold by the Colt Firearm Company. More particularly, the hand gun shown in FIG. 1 comprises a barrel portion "B" and a cooperating grip portion "G". Barrel portion "B" includes a slidable portion "S"which is movable rearwardly with respect to grip "G" to actuate the firing mechanism of the weapon. A safety lever "L" is pivotally connected to the grip portion of the weapon and is movable from a downward weapon firing position into an upper safing position as shown in FIG. 1. When the lever "L" is in the safing position, the sliding portion of the barrel of the weapon is locked against rearward movement and the hammer is locked thereby disabling the weapon. Only after the safing lever "L" is moved downwardly from the position shown in FIG. 1 and into a weapon operating position can the hammer fall and the sliding portion of the barrel be moved in a manner to render the hand gun fully operable.

Figure 3:
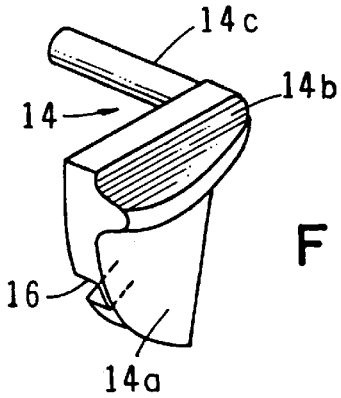
FIG. 3 is a generally perspective view of the modified safety lever of the present invention.

When a prior art hand gun of the character shown in FIG. 1 is modified in accordance with the present invention, the safety lever "L" is replaced by a safety lever 14 of the character shown in FIG. 3. Like safety lever "L"modified safety lever 14 is pivotally connected to the grip portion of the hand gun for pivotal movement between an upper safing position and a downward weapon operating position. Modified safety lever 14 includes a body portion 14*a* and a thumb engagement portion 14*b* which is used to pivot the safety lever downwardly into the weapon operating position. A pivot pin 14*c* extends outwardly from one side of body portion 14*a* of the safety lever and defines the pivot axis about which the safety lever pivots. For a purpose presently to be described, a locking pin receiving slot 16 is formed in body portion 14*a* of the modified safety lever.

Figure 2:
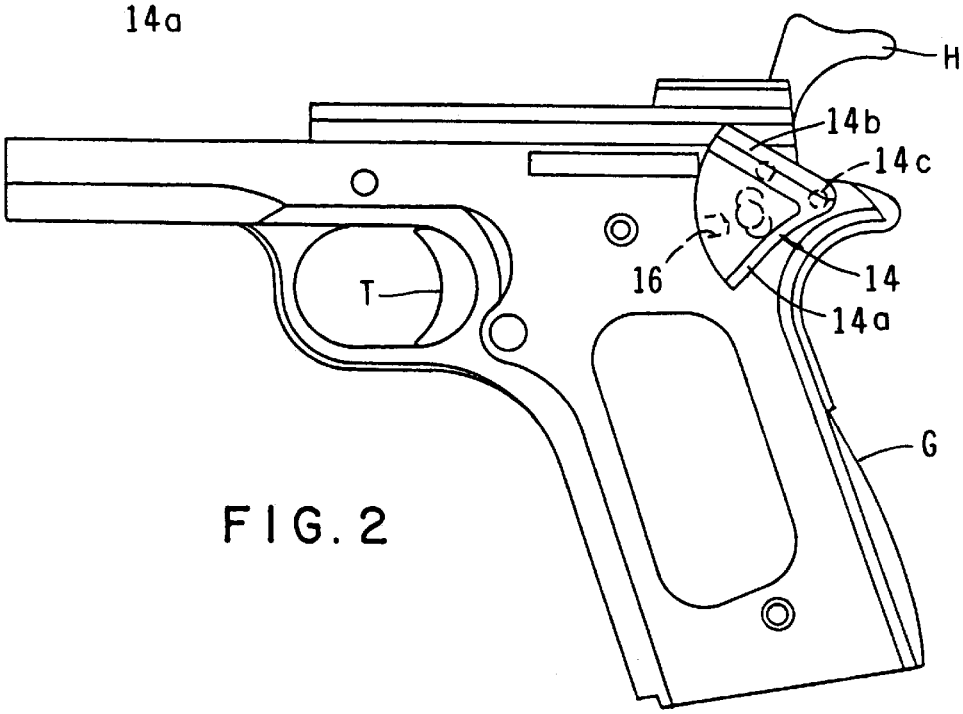
FIG. 2 is a side-elevational view of a portion of the prior art hand gun having embodied therewithin the modified safety lever of the safety system of the invention.

Referring particularly to FIG. 2, the modified safety lever 14 of the invention is shown mounted on the prior art hand gun, the sliding barrel portion of which has been removed to better illustrate the configuration of the slide and the hammer element "H" of the weapon. After the weapon has been placed into a firing condition, hammer "H" is released by operation of a trigger mechanism "T" which is of conventional construction.

To positively prevent movement of the modified safety lever 14 from a first safety, or blocking position, to a second operating position, novel blocking means are provided. As best seen by referring to FIG. 6, this novel blocking means of the invention here comprises uniquely configured locking pawl 18 which is pivotally connected to the grip portion of the weapon for pivotal movement about a pivot pin 20. Pawl 18 includes a body portion 18*a* and a locking pin 18*b* which is connected to and extends outwardly from body portion 18*a* in the manner shown in FIG. 6. In the manner shown in FIG. 10, locking pin 18*b* is closely receivable within the previously mentioned slot 16 which is formed in modified safety lever 14. When the modified lever is in the safing position shown in FIG. 10, pin 18*b* is closely received within slot 16 and functions to prevent pivotal movement of the safety lever 14 from the safe position shown in FIG. 10 into the weapon operating position shown in FIG. 14.

Figure 14:
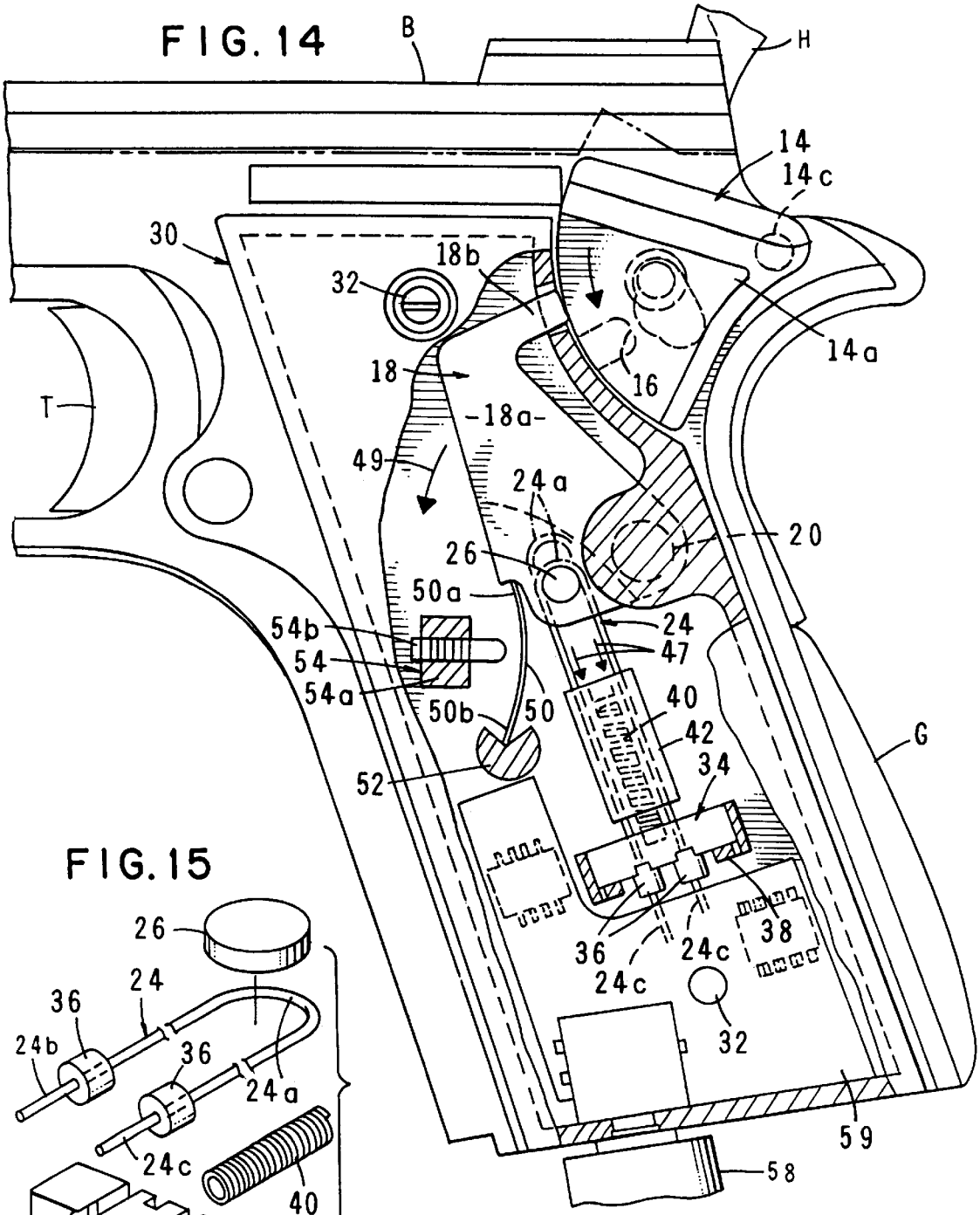
FIG. 14 is a greatly enlarged, fragmentary view similar to FIG. 10, but showing the safety lever having been moved into a weapon firing position.

To controllably move pawl 18 from the safety locking position shown in FIG. 10 into the weapon operable position shown in FIG. 14, novel operating means are provided. These novel operating means which are carried by the handle grip portion of the weapon comprise a novel actuator which is provided in the form of a novel electrical current conductor 24. Conductor 24, which has a length of about 2.9 inches, is connected to the locking means or pawl 18 in the manner shown in FIG. 10 and functions to move the locking means from the first locking position shown in FIG. 10 into the second operating position shown in FIG. 14. In a manner which will be more fully described in the paragraphs which follow, electrical current conductor 24 is of a character such that when no current is flowing through the conductor, the conductor exhibits a first overall length. However, upon current flowing through the conductor, the conductor will shrink and will exhibit a second overall length which as shown in FIG. 14 is less than the static, noncurrent conducting length of the conductor 24 as shown in FIG. 10.

Also forming an important part of the operating means of the form of the invention shown in the drawings is actuating means which is operably associated with electrical current conductor 24 for causing an electrical current to flow through the electrical conductor and accordingly to move the safety lever from a safe or weapon disabling condition into a weapon firing condition. The details of this novel actuating means will presently be described.

Figure 15:
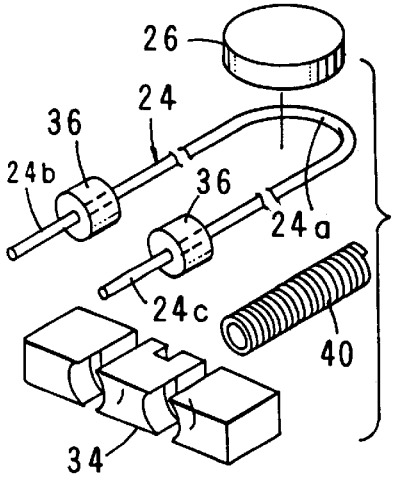
FIG. 15 is an enlarged, generally perspective, exploded view of the wire actuator portion of the operating mechanism of the safety system of the invention.

Referring particularly to FIGS. 10 and 15, it is to be noted that the blocking means of the invention further comprises a wire engagement means, shown here as an engagement pin 26 which is connected to body portion 18*a* of pawl 18 and about which electrical conductor 24 or wire passes. More particularly, as best seen in FIG. 15, electrical conductor 24 includes a central portion 24*a* which is entrained about engagement pin 26 and a pair of oppositely disposed leg portions 24*b* and 24*c* respectively. The end portions of the legs 24*b* and 24*c* of the electrical conductor or length of wire 24 are operably interconnected with the actuating means of the invention so that upon the occurrence of a particular sequence of events, electrical current will be caused to flow through the electrical conductor 24.

Turning next to FIGS. 4 through 8, it is to be observed that the hand grip portion "G" of the weapon includes a side cover 30 which is removably connected to grip portion "G" by suitable connector elements 32. As indicated in FIGS. 5, 7, 8, and 9, cover portion 30 includes an elongated central cavity portion 30*a* within which a portion of the actuating means of the invention is uniquely housed. The method by which portions of the actuating means are housed within cover 30 will be discussed further in the paragraphs which follow.

As indicated in FIG. 16, the lower side portions of electrical conductor 24 pass-through, spaced-apart wire receiving slots provided in a wire cross head 34 and are connected proximate their lower extremities to a pair of spaced-apart, cross-head engagement members generally designated in FIG. 15 by the numeral 36. Wire cross head 34 is slidably mounted within a cross-head guide 38 which as shown in FIG. 9 is mounted within handle grip cover portion 30. Associated with wire cross head 34 is biasing means which functions to yieldably resist sliding movement of the wire cross head relative to the cross-head guide 38. This biasing means here comprises a coil spring 40 which is carried by a support block 42, which, as shown in FIG. 8 is also mounted within cover portion 30. Support block 42 includes a central portion 42*a* which supports spring 40 and is provided with a pair of transversely, spaced-apart wire receiving slots 42*b* which are adapted to receive the side portions of electrical conductor or wire 24 (FIGS. 6 and 8). With the construction just described, it is possible, under certain conditions, for wire cross head 34 to slidably move within cross-head guide 38 against the urging of spring 40 in the direction of the arrows 45 of FIG. 16. As will be discussed in greater detail hereinafter, the ability of the cross head 34 to move in this manner functions to prevent undue stresses to be imposed upon wire 24 as it alternately contracts and expands.

Electrical conductor 24 comprises a length of wire which is commercially available from Dynalloy, Inc. of Irvine, Calif. and exhibits unusual and highly useful characteristics. More particularly, this novel material which is sold under the name and style "FLEXINOL", exhibits unusual stability and uniquely contracts much like human muscle fiber when heated to exert substantial force for its small size. In one form, the electrical conductor 24 is constructed of a nickel titanium alloy wire, which is available in a variety of sizes as small as 0.003 inches in diameter. When electrical current is passed through the conductor, resistance causes the conductor to heat and thereby contract and exhibit a capability of exerting significant mechanical forces while doing so.

The FLEXINOL material is ideally suited for use as the actuator component in the present invention. More particularly, when the length of FLEXINOL wire 24 is initially entrained over pin 26 in the manner shown in FIGS. 6 and 10 it is in a static condition and exhibits a first length. However, when electrical current heats the wire, the overall length of the wire becomes shorter and in so doing will cause substantial forces to be exerted in the direction of the arrows 47 of FIG. 14. Exertion of these forces will cause pawl 18 to pivot about pin 20 in the direction of the arrow 49 of FIG. 14 causing locking pin 18*b* to be completely withdrawn from slot 16 of safety lever 14 so as to enable the lever to be moved into the gun enabling configuration shown in FIG. 14.

Referring particularly to FIGS. 10 and 14, it is to be noticed that a novel, second biasing means is provided to yieldably resist pivotal movement of blocking pawl 18 from the locking position shown in FIG. 10 into the gun enabling or firing position shown in FIG. 14. This second biasing means here comprises a yieldably deformable, flat spring 50 which has a first end 50*a* in engagement with a notch provided in body portion 18*a* of pawl 18 and a second end 50*b* in engagement with a uniquely configured supporting pin 52. To retain end 50*b* of spring 50 in engagement with pin 52, the pin is provided with a generally V-shaped indentation of the character shown in FIGS. 10 and 14. With this construction, when electrical current is caused to flow through conductor 24, the conductor will, as previously discussed, be foreshortened causing pivotal movement of pawl 18 in the manner shown in FIG. 14. This pivotal movement is resisted by biasing means or spring 50 so that upon pivotal movement of the pawl, spring 50 will be deflected in the manner shown in FIG. 14. However, when the locking pawl 18 returned to the locked position shown in FIG. 10, flat spring 50 will also return to its normal unflexed condition as shown in FIG. 10. To prevent flat spring 50 from moving past the normal in-line, flat configuration shown in FIG. 10, stop means, shown here as a stop pin assembly 54, is provided. Stop pin assembly 54 comprises a supporting block 54*a* and a spring engagement pin 54*b*, the outer extremity of which engages the central portion of flat spring 50 when the pawl 18 is in the safety locking position shown in FIG. 10 and positively prevents the spring from moving into an "over center" position.

Forming another extremely important aspect of the operating means of the invention is the previously mentioned actuating means which is operably associated with electrical current conductor 24 for causing a current to flow through the current conductor upon the occurrence of a predetermined sequence of events. In the form of the invention shown in the drawings, the actuating means comprises a novel module portion and a cooperating associated code key portion 58. As depicted in FIGS. 12 and 14, code key portion 58 can be physically interconnected with the grip portion of the weapon so as to electrically interconnect the code key with the module portion to enable the transmission of a particular code signal to the code recognition means of the module portion. The code recognition means includes a signal output means which is operably associated with the electrical conduit or wire 24 for causing electrical current to flow through the wire upon the code recognition means recognizing a pre-determined code signal transmitted by the code key (see also FIG. 17).

Figure 17:
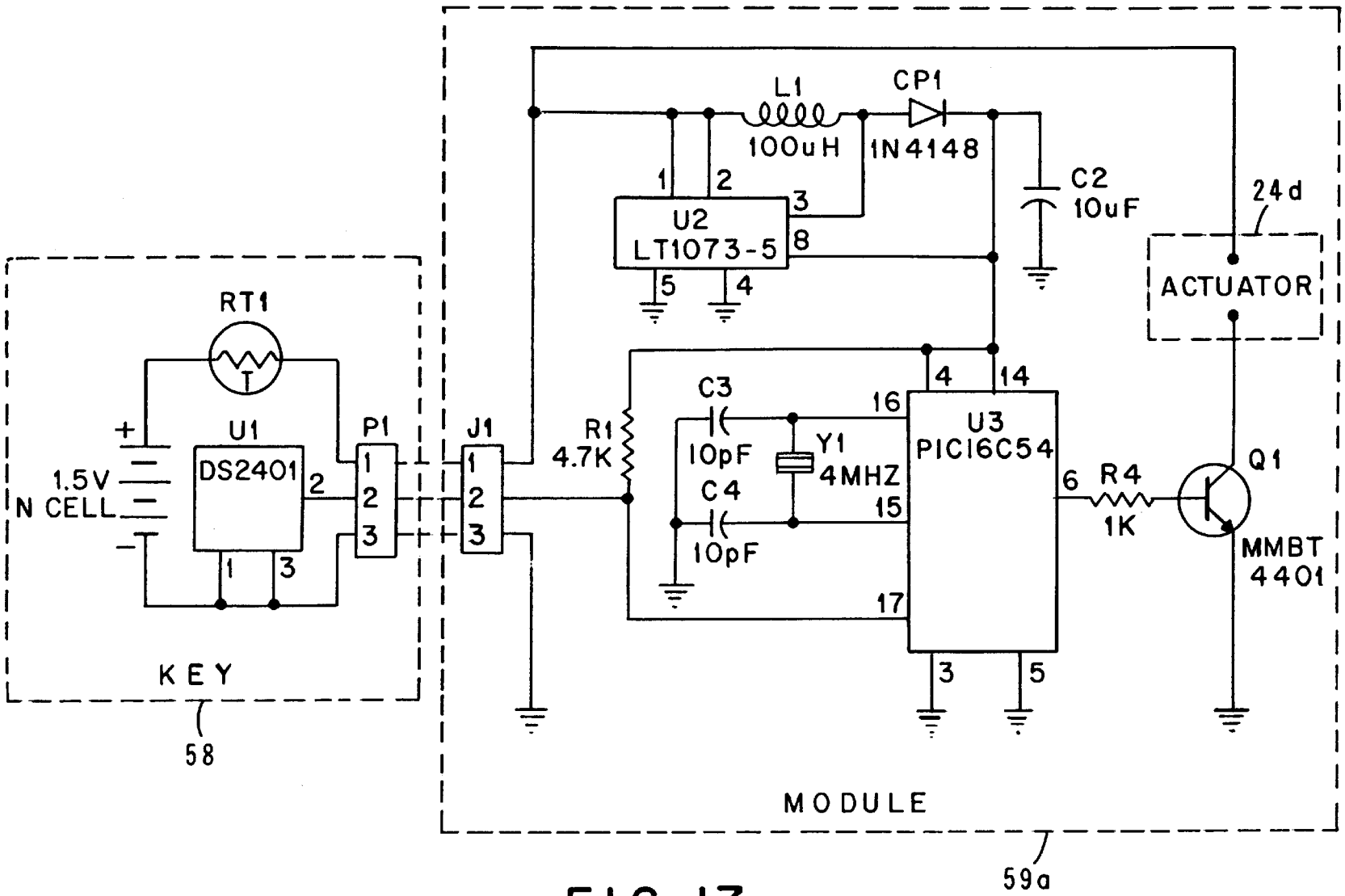
FIG. 17 is a generally schematic view of one form of the electrical circuitry of the safety system of the invention.

As best seen by referring to FIGS. 6, 10, and 17 the module portion of the device includes a control circuit board 59 upon which is mounted a micro processor which is programmed to recognize the code signal transmitted by code key portion 58 of the apparatus. As indicated in FIG. 17, code key portion 58 includes an embedded Dallas semi-conductor chip of the character sold under the model No. DS2401. This commercially available chip comprises a memory and a communications code which stores a unique 64 bit number as issued by the Dallas Semiconductor Co. of Dallas, Tex. The code format and communication/interrogation protocol for the semiconductor chip is described in a publication issued by Dallas Semiconductor Co. entitled "Automatic Identification Data Book". The method of interconnection of this chip into the circuitry shown in FIG. 17, as well as the circuitry itself, is well understood by those skilled in the art. As indicated in FIG. 17, code key portion 58 contains a data contact and a ground contact which interfaces with mating contacts disposed within the cover 30 so that the microprocessor can suitably read the code contained within the code key. In practice, code key portion 58 preferably includes a 1.5 volt alkaline battery, the previously mentioned semiconductor memory chip U-1 which is programmed with a unique code, and thermister RT-1 which functions to provide short circuit protection. As indicated in FIG. 17, code portion key 58 also includes connector pins 1, 2, and 3 which function to interconnect the code key with the previously identified module portion 59*a* of the actuating means which includes circuit board 59.

In the form of the invention shown in the drawings, module portion 59*a* includes a microchip PIC 16C 54 microprocessor of the character readily commercially available from sources such as Future Electronics and Digi-Key Company. As depicted in FIG. 17, plug P-1 on code key portion 58 is inserted into receptacle J-1 of module 59*a* so that the microprocessor can be powered up to enable it to read the code being transmitted from the memory chip U-1 carried by code key portion 58. If the microprocessor recognizes the code, it energizes the output transistor in a manner to supply power to the electrical conductor 24 which is identified in FIG. 17 as actuator 24*d*.

As previously discussed, a flow of electrical current through electrical conductor or wire 24, heats the wire causing it to exert substantial forces on engagement pin 26 (FIG. 14). These forces will cause pivotal movement of the safety pawl from the safing position shown in FIG. 10 to the unlocked, gun-enabling position shown in FIG. 14. On the other hand, if the microprocessor does not recognize the code being transmitted by the code key, nothing will happen and the weapon will remain in a disabled, locked condition. If the code transmitted by the code key is correct, recognition will occur within milliseconds. However, because of the unique design of the circuitry of the apparatus as shown in FIG. 17, actuator 24*d* remains energized for only approximately 3 seconds so that if the code key remains physically interconnected with the module, the weapon will not necessarily remain in an unlocked operable condition.

Interconnection of pin P-1 and J-1 also interconnects code key 58 with a D-C/D-C converter U-2 designated in FIG. 17 by the indicia LT1073-5 which is also available from either of the Future Electronics or Digi-Key companies. Connection of pin 3 of code key 58 with pin 3 of module 59*a* interconnects the code key with the ground in the manner shown in FIG. 17. Interconnection of pins 2 of pin P-1 and J-1 respectively interconnect code key 58 with microprocessor U-3 of module 59*a* via resistor R-1. Microprocessor U-3 is also interconnected with a transistor Q-1 via resistor R-4. Interconnected between converter U-2 and microprocessor U-3 is a 100 UH inductor L-1 and a IN4148 diode CR1. Disposed between ground and diode CR1 is a 10 UF capacitor C2. Inductor L1, diode CR1 and capacitor C2 work in concert with convertor U-Z to supply five volts to power microporcessor U-3.

In practicing the invention described in the preceding paragraphs, a conventional hand gun such as the Colt 45 hand gun shown in FIG. 1 is modified by first removing the handle grip and then removing lever "L". Lever "L" is then replaced with the modified lever 14 of the invention which is of the character shown in FIG. 3. Next, the handle-grip cover of the prior art weapon is replaced with the modified hand-grip cover of the character shown in FIGS. 6, 7, 8, and 9. This modified cover is configured such that the hand-grip portion of the conventional weapon need not be modified to accept the cover 30 of the present invention which contains the operating means of the invention for operating the modified lever assembly 14.

After the weapon has been modified into the general configuration shown in FIG. 10, when the safety lever is moved into the safing position shown in FIG. 10, spring 50 will urge pin 18*b* of pawl 18 into slot 16 which has been provided in modified lever 14 (FIGS. 3 and 10). With the apparatus in this configuration, it is apparent that safety lever 14 cannot be moved from the disabling position shown in FIG. 10 into an enabling position which would permit the slide "S" of the weapon to be retracted. In point of fact, the only way in which the lever 14 can be moved into the gun firing position is to insert the proper code key 58 into the grip portion of the modified apparatus in the manner shown in FIGS. 12 and 14. With the code key properly inserted, the microprocessor U-3 can be powered up to enable it to read the code being transmitted from the memory chip U-1 carried by code key portion 58. If the microprocessor recognizes the code, it will energize the output transistor of the circuitry in a manner to supply power to the electrical conductor or wire 24. Upon current flowing through electrical conductor or wire 24, the wire will uniquely foreshorten causing substantial forces to be exerted on engagement pin 26 which tend to cause pivotal movement of the safety pawl 18 from the locking position shown in FIG. 10 to the unlocked position shown in FIG. 14. With the locking pawl in this unlocked position, the safety lever 14 can be moved from the disabling position shown in FIG. 10 into the weapon firing position shown in FIG. 14. On the other hand, if the microprocessor does not recognize the code being transmitted by the code key, the weapon will remain in a disabled configuration.

It is to be understood that, while the discussion in the preceding paragraphs envisions modification of a particular type of prior art hand gun, namely a Colt 45, the apparatus of the invention can also be incorporated into a wide variety of other prior art hand guns having a design similar to the hand gun depicted in FIG. 1 of the drawings. Accordingly, the application of the apparatus of the invention is in no way intended to be limited to a modification of any particular prior art weapon.

Having now described the invention in detail in accordance with the requirements of the patent statutes, those skilled in this art will have no difficulty in making changes and modifications in the individual parts or their relative assembly in order to meet specific requirements or conditions. Such changes and modifications may be made without departing from the scope and spirit of the invention, as set forth in the following claims.

I claim:

1. An apparatus for preventing the unauthorized firing of a weapon of the character having a grip portion and a pivotally movable safety lever which is movable from a safing location wherein the weapon cannot be fired to a release location wherein the weapon is operable, said apparatus comprising:

(a) blocking means for blocking movement of the safety lever, said blocking means comprising a locking pawl pivotally connected to the grip portion for movement between first and second positions, said locking pawl including a locking pin disposed in locking engagement with the safety lever when said locking pawl is in said first position;

(b) operating means carried to the grip portion of the weapon and operably associated with said blocking means for moving of said locking pawl from said first position to said second position, said operating means comprising:

(i) an electrical current conductor connected to said locking pawl for moving said locking pawl from said first position to said second position upon a current flowing through said current electrical conductor, said electrical current conductor comprising a length of wire having a first length and having a second, shorter length upon an electrical current flowing through said length of wire; and (ii) actuating means operably associated with said electrical current conductor for causing a current to flow through said electrical current conductor.

2. An apparatus as defined in claim 11 in which said blocking means further comprises an engagement pin connected to said locking pawl and extending therefrom, said length of wire having a central portion entrained about said engagement pin and first and second end portions connected to said actuating means.

3. An apparatus as defined in claim 11 in which said blocking means further includes biasing means for biasing said locking pawl toward said first position.

4. An apparatus as defined in claim in which said actuating means comprises:

(a) A module portion including code recognition means for recognizing a code and output means connected to said code recognition means and to said length of wire for causing electrical current to flow through said wire upon said code recognition means recognizing said code; and (b) a key portion interconnectable with said module portion for transmitting said code to said code recognition means.

5. An apparatus as defined in claim 4 in which said code recognition means comprises a microprocessor programmed to recognize said code.

6. An apparatus as defined in claim 5 in which said key portion comprises a semiconductor memory chip programmed with said code.

7. An apparatus as defined in claim 6. in which said key portion comprises:

(a) a housing for housing said semiconductor memory chip; and (b) a connector pin mounted on said housing for interconnecting said semiconductor memory chip with said microprocessor.

8. An apparatus as defined in claim 6 in which said wire comprises nickel titanium.

9. An apparatus for preventing the unauthorized firing of a weapon of the character having a grip portion and a pivotally movable safety lever which is movable from a safe location wherein the weapon cannot be fired to a release location wherein the weapon is operable, said apparatus comprising:

(a) blocking means for blocking movement of the safety lever, said blocking means being movable from a first position blocking movement of the safety lever toward the release location to a second position permitting movement of the safety lever toward the release location;

(b) operating means carried by the grip portion of the weapon and operably associated with said blocking means for controllably moving said blocking means from said first position to said second position, said operating means comprising:

(i) an electrical current conductor connected to said blocking means for moving said blocking means from said first position to said second position upon a current flowing through said electrical current conductor, said electrical current conductor comprising a length of wire having a first static length and a second length shorter than said static length upon said wire being heated by an electrical current flowing through said wire; and (ii) actuating means operably associated with said electrical current conductor for causing an electrical current to flow through said electrical conductor.

10. An apparatus as defined claim 9 in which said actuating means comprises:

(a) a module portion including code recognition means for recognizing a code and output means connected to said code recognition means and to said length of wire for causing electrical current to flow through said wire upon said code recognition means recognizing said code; and (b) a key portion interconnectable with said module portion for transmitting said code to said code recognition means.

11. An apparatus as defined in claim 10 in which said code recognition means comprises a microprocessor programmed to recognize said code.

12. An apparatus as defined in claim in which said key portion comprises a semiconductor memory chip programmed with said code.

* * * * *